US007083088B2

(12) United States Patent
Yamamiya

(10) Patent No.: US 7,083,088 B2
(45) Date of Patent: Aug. 1, 2006

(54) METHOD AND APPARATUS FOR DISPENSING FLEXIBLE CARDS

(75) Inventor: Takahito Yamamiya, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 195 days.

(21) Appl. No.: 10/870,392

(22) Filed: Jun. 17, 2004

(65) Prior Publication Data

US 2005/0023342 A1 Feb. 3, 2005

(30) Foreign Application Priority Data

Jun. 30, 2003 (JP) ..... 2003-186076

(51) Int. Cl.
*G06F 7/08* (2006.01)

(52) U.S. Cl. ..... 235/381; 235/379; 235/475; 221/144

(58) Field of Classification Search ..... 221/217, 221/144, 146
See application file for complete search history.

(56) References Cited

U.S. PATENT DOCUMENTS

| | | | | |
|---|---|---|---|---|
| 4,993,587 | A | 2/1991 | Abe | 221/21 |
| 5,017,953 | A * | 5/1991 | Biondo, Jr. | 396/2 |
| 5,542,571 | A | 8/1996 | Belka | 221/268 |
| 6,102,248 | A * | 8/2000 | Yamamiya | 221/211 |
| 6,129,275 | A * | 10/2000 | Urquhart et al. | 235/381 |
| 6,168,150 | B1 * | 1/2001 | Hori et al. | 271/121 |
| 6,311,867 | B1 | 11/2001 | Yamamiya | 221/217 |

* cited by examiner

*Primary Examiner*—Seung H Lee

(57) ABSTRACT

A support unit supports a plurality of flexible cards arranged in a stack. A pickup unit adjacent to the stack of flexible cards attracts a first card from the stack of cards, bending the flexible card. A transporting unit adjacent to the pickup unit receives and moves the first card attracted by the pickup unit along a card dispensing passageway. A biasing unit having at least one biasing roller with at least one radial projection from the biasing roller urges a portion of the first card towards the card dispensing passageway. A method of dispensing flexible cards includes movement of cards away from the pickup unit after the first card is attracted to prevent inadvertently dispensing more than one card.

18 Claims, 5 Drawing Sheets

METHOD AND APPARATUS FOR DISPENSING FLEXIBLE CARDS

CROSS-REFERENCE TO RELATED APPLICATION

This application is based on application number 2003-186076 filed in Japan, dated Jun. 30, 2003.

FIELD OF THE INVENTION

This invention is related to a card dispensing apparatus and more particularly to a card dispensing apparatus adapted for dispensing flexible and slightly bent cards.

DESCRIPTION OF RELATED ART

Traditional card dispensing devices are known. Examples of the state of the art are shown by the following references: U.S. Pat. No. 6,311,867 to Takahito Yamamiya (Especially FIGS. 6, and 8–9), Japanese Laid open Patent 2001-118137 (Especially FIGS. 6, 8, 9 and pages 4–5), U.S. Pat. No. 4,993,587 to Hiroshi Abe (Especially FIGS. 1, 2 and 5), and U.S. Pat. No. 5,542,571 to Jeffrey Belka (Especially FIGS. 3 and 7). However, the devices taught by all of these references can still encounter significant problems when the card is bent prior to or during dispensing.

Bending of the cards can be due to many factors. A card can be composed of two sheets of different materials affixed together as in a lamination of the two sheets. In this case, when the temperature and/or humidity changes, the laminated sheets can bend like two plates of dissimilar metals each having different contraction coefficients and forming a single bent card. When the bent card is dispensed by the above-mentioned references, the end of the card is displaced from proper alignment with a dispensing passageway and may not be successfully guided to a dispensing slot.

In some cases, the bent card is not dispensed because a roller may not have contact with the card, or because the trailing edge of the card is pushed by a pusher member that increases the amount of bending of the card. An attempted solution to these problems has included guiding the card by a pair of guiding plates. However, the frictional resistance between the guiding plates and the cards may be large and can require a correspondingly large driving force. This can result in a larger and more costly device to manufacture as well as unreliable operation.

SUMMARY OF THE INVENTION

The present invention, as defined in the claims, overcomes the deficiencies of the prior art by providing an improvement that includes a biasing unit including a biasing roller having a plurality of radial projections for more capturing the end of a bent card and reliably dispensing the card that was displaced from the card dispensing passageway due to bending. In this specification the term "card" is a generic name that may include a card which is enclosed in a wrapper, or simply the card itself. The card can be a telephone calling card, a pre-paid card, a trading card, a medicine packet, or an integrated circuit card, for example. The wrapper can be made of paper, resin, aluminum film, cellophane, or MYLAR film. The wrapper can be formed into a bag for encapsulating the card and can be air tight or permit the passage of air into and out of the wrapper, for example.

An embodiment of the present invention includes a support unit for supporting a plurality of cards arranged in a stack, a vacuum unit disposed adjacent to the stack of cards for attracting a first card in the stack of cards, a transporting unit for receiving and moving the first card attracted by the vacuum unit, and a biasing unit for urging the first card towards a card dispensing passageway. The vacuum unit and the transporting unit are located adjacent to a first side of the passageway while the biasing unit is located adjacent to a second side of the passageway. The biasing unit includes a radial projection extending from the surface of the biasing roller for moving the first card along the card dispensing passageway towards a dispensing slot. A pinching roller contacts the biasing roller. The pinching roller is located next to the card dispensing passageway on a side opposite the biasing roller.

In an embodiment, the biasing unit includes at least one biasing roller having at least one radial projection for contacting a portion of the first card. The radial projections can include a plurality of grooves for capturing an end of the first card. The biasing roller is not actively driven, but rather is passively rotating due to contact with a portion of the transporting unit. The biasing roller can include an abrasion resistant rubber such as Ethylene-Propylene Diene Monomer (EPDM).

In an embodiment, a method for dispensing a card includes generating a vacuum stream to attract a first card from a plurality of cards into a dispensing position adjacent to a dispensing unit. The first card can be bent by contact with the dispensing unit so that a leading edge of the bent first card is displaced from alignment with a card dispensing passageway. The method further includes contacting the leading edge of the bent first card in the dispensing direction with a projection to push the leading edge into alignment with the card dispensing passageway.

In an embodiment, a method for dispensing a card includes moving a support unit for supporting a plurality of stacked cards in a first direction away from a dispensing unit until a position sensor indicates a first card from the plurality of stacked cards cannot be dispensed by the dispensing unit. The method further comprises moving the support unit in a second direction towards the dispensing unit until a position sensor indicates the first card can be dispensed by the dispensing unit. Once the first card is optimally aligned, the method includes generating a vacuum stream to attract the first card into a dispensing position adjacent to the dispensing unit. The first card can be bent by contact with the dispensing unit so that a leading edge of the bent first card in the direction of dispensing is displaced from alignment with a card dispensing passageway.

Once the first card is attracted to the dispensing unit by the vacuum stream, the method includes moving the support unit again in the first direction away from the dispensing unit to avoid inadvertently dispensing a second card in the stack immediately following the dispensing of the first card. The method further includes contacting the leading edge of the bent first card in the dispensing direction with a projection to push the leading edge into alignment with the card dispensing passageway. A control unit receives a dispensing request signal along with a dispensing sensor signal, a position sensor signal, and a duplicate sensor signal to properly activate a first motor, a second motor, and a third motor.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
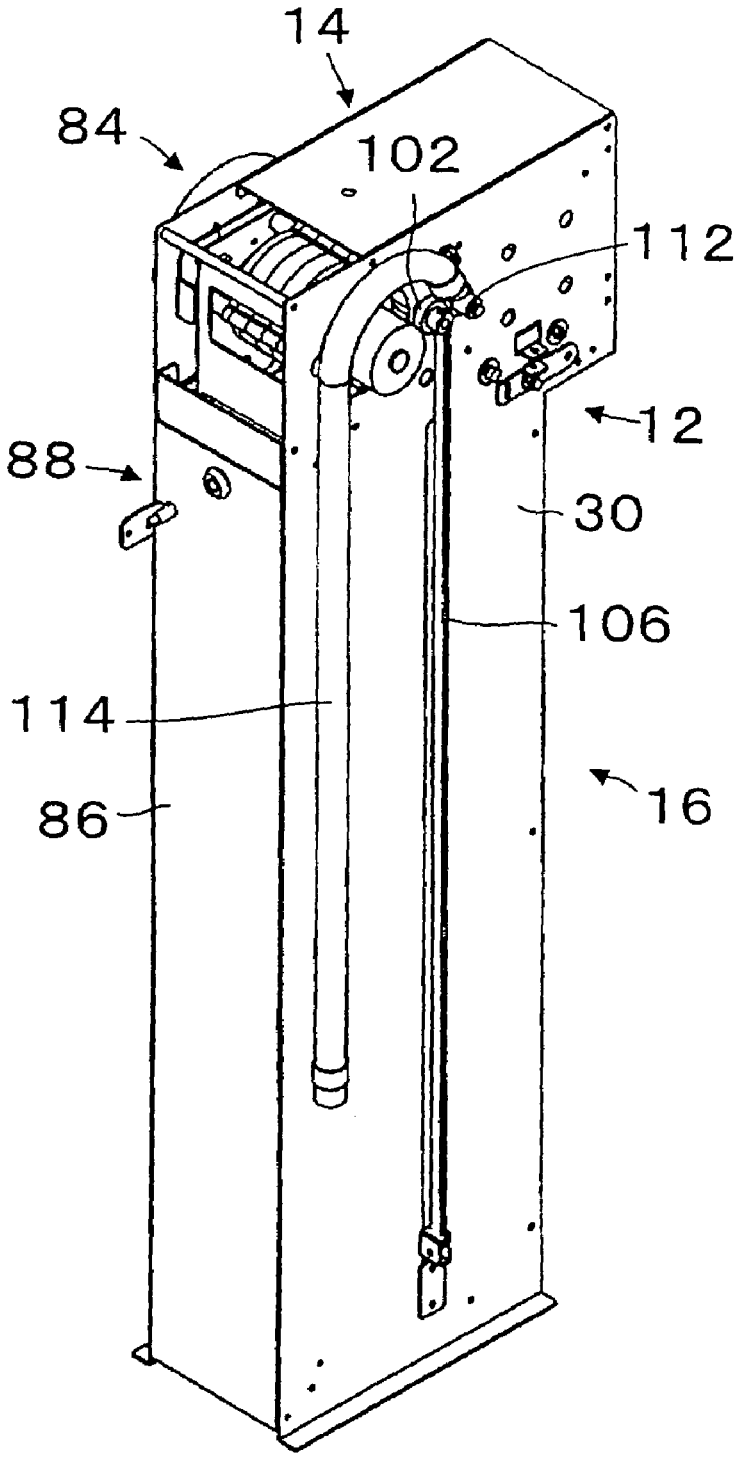
FIG. 1 is a perspective view of the automatic card dispensing apparatus in accordance with an embodiment of the present invention.

In reference to FIG. 1, an automatic card dispensing apparatus 12 is shown and described. The automatic card dispensing apparatus 12 for dispensing cards 10 in a one-by-one manner includes a card dispensing section 14 and a card storing section 16. In reference to FIG. 2, the automatic card dispensing apparatus with the left-side cover removed is shown and described. A vacuum unit 22 draws in air to create a vacuum stream and has a function of pulling the top card 10 from a stack of cards carried upon a platform 82. The vacuum unit 22 may be considered as a pickup unit 22 with the function of attracting the top card 10 from the stack of cards. Alternatively, the pickup unit may include a suction cup for attracting the uppermost card 10 from the stack of cards. The platform 82 may be considered as part of a support unit for supporting the stack of cards.

Alternatively, instead of a planar surface, the support unit can include a piece-wise planar surface formed by two or more surfaces into a substantially planar support. In reference to FIG. 3, a cross sectional view of the dispensing section 14 is shown and described. The dispensing section 14 includes a dispensing unit 18 and a duplicate detecting sensor 20, a vacuum unit 22, and transporting unit 24. The vacuum unit 22 includes a guiding tube 26 and a vacuum generating unit 28. The guiding tube 26 is fixed at the side frame 30 and has a rectangular cross section. The lower end of the guiding tube 26 has a vacuum opening 32 for drawing in air to the vacuum unit 22 and creating a vacuum stream.

The vacuum generating unit 28 includes a first electric motor 34 with a fan that is fixed on an output shaft. The motor 34 is fixed on the upper end of the guiding tube 26. When the motor 34 rotates, an upwardly moving stream of air, the vacuum stream, is created and flows into the lower end of the guiding tube 26. Alternatively, the vacuum generating unit 28 may be considered to be a blower with the same functions and air flow pattern as described. In another alternative, the fan or air moving device within the vacuum generating unit 28 can be driven by pneumatic power.

The transporting unit 24 receives the top card 10 from the stack of cards supported on the platform 82 by drawing air into the vacuum unit 22 and moves the top card 10 in a lateral direction. The transporting unit 24 includes a first transporting unit 36 that is located in the path of the guiding tube 26 and a second transporting unit 38 that is located to the side of the guiding tube 26. The outer surface of first transporting unit 36 slightly protrudes downwards from vacuum opening 32 for transporting card 10 that is pulled by the vacuum opening 32 to the second transporting unit 38.

In one embodiment, the first transporting unit 36 is a first roller 42 that is fixed on a rotating shaft 40. An end of the rotating shaft is fixed at the side wall of guiding tube 26 and is held level. Alternatively, the first transporting unit 36 can include a driving belt which moves towards the second transporting unit 38. The first roller 42 can be covered with a rubber coating or sleeve for increasing the gripping capability and reducing slip with the card 10.

The second transporting unit 38 transports card 10 that was transported from the first transporting unit 36 towards a dispensing slot 44. In one embodiment, the second transporting unit 38 includes a pair of rollers. A second roller 48 is fixed on a second rotating shaft 46. The second rotating shaft 46 is parallel to the first rotating shaft 40 and is similarly affixed at the side frame 30. The second roller 48 can be covered with a rubber coating. The second roller 48 can be considered as a pinching roller 50.

Figure 3:
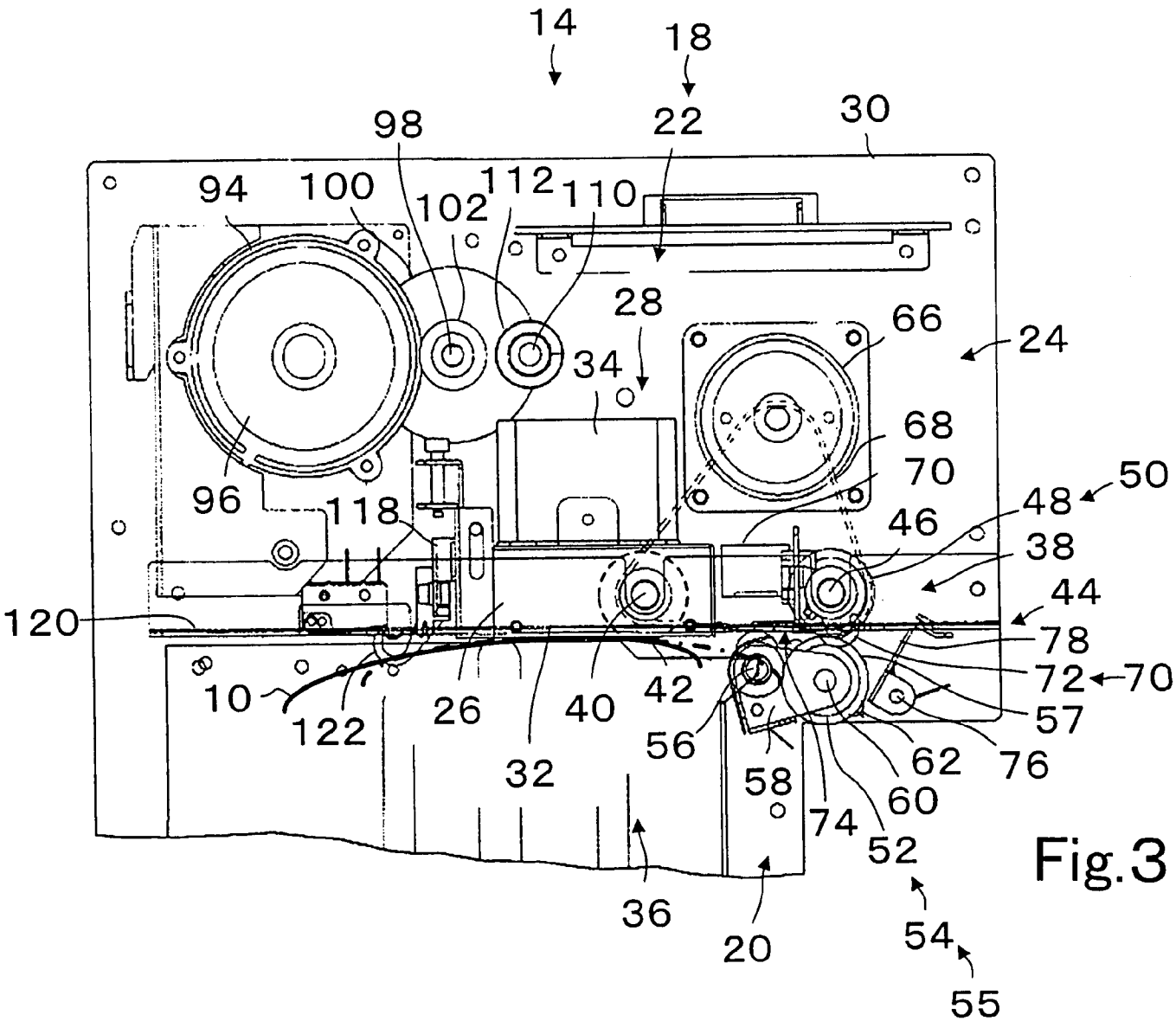
FIG. 3 is a cross sectional view of the dispensing section in accordance with an embodiment of the present invention.

A third roller 52 is located below the pinching roller 50. The third roller 52 can be considered as a biasing roller 54 for providing pressure against the pinching roller. One ore more biasing rollers 54 can be considered as an embodiment of a biasing unit 55. Alternatively, the biasing roller 54 can be changed to another type of moving device which has the same function and where the leading edge of the card 10 in the direction of dispensing is drawn into alignment with a card transporting passageway 74. The direction of dispensing is from left to right as shown in FIG. 3.

The card 10 may not be properly aligned if the card 10 is bent after being drawn up by the vacuum unit 22. If the card 10 is bent, the end or leading edge of the card 10 can be displaced from proper alignment with the dispensing passageway 74 and may not be successfully guided to a dispensing slot 44. Biasing roller 54 is ring-like in shape and can be made from rubber which is resistance to abrasion: for example an Ethylene-Propylene Rubber such as Ethylene-Propylene Diene Monomer (EPDM), and it includes a radial projection 62 which protrudes from the surface of the biasing roller 54 in a peripheral direction.

Figure 4:
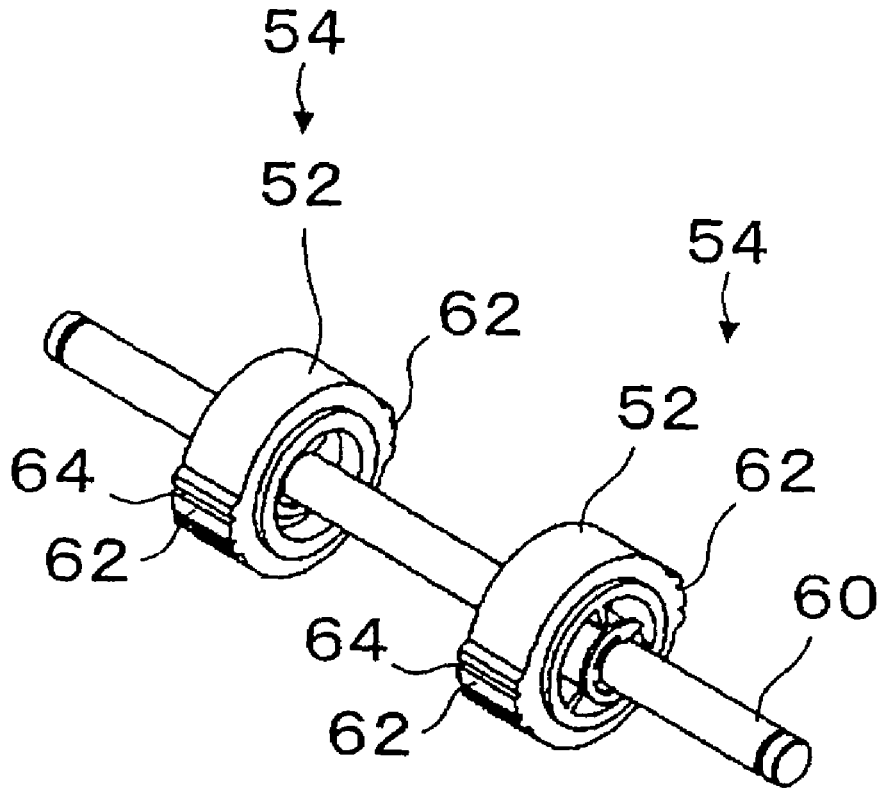
FIG. 4 is a perspective view of the biasing unit including two biasing rollers in accordance with an embodiment of the present invention.
Figure 5:
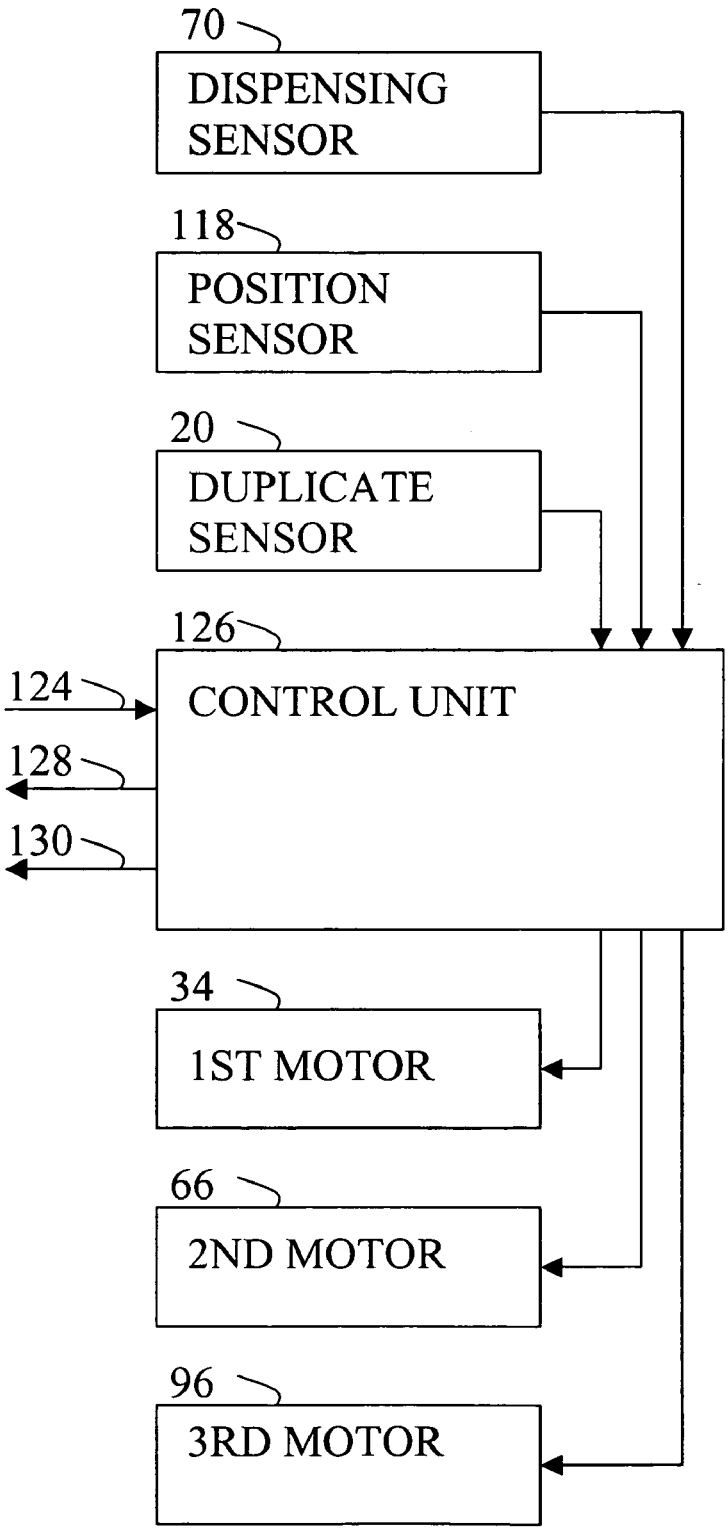
FIG. 5 is a block diagram showing the interface between the control unit, the sensors, and the motors in accordance with an embodiment of the present invention.

The biasing roller 54 can include a single projection 62, but preferably includes at least two projections evenly spaced around the periphery of the biasing roller 54 as shown in FIG. 4. The end of each projection 62 can include at least one groove 64 for hooking or catching an end or edge of the card 10 as the biasing roller 54 is rotated. This hooking or catching may be considered capturing since the one or more grooves facilitate a more positive contact with the end of the card 10. Furthermore the section of biasing roller 54 which faces to the passageway 74 can be considered as a mover 57 which moves towards dispensing slot 44. The biasing unit 55 can include only one biasing roller 54, but preferably includes at least two biasing rollers 54. Both ends of a shaft 60 are supported by a lever 58 that can pivot at a fixed shaft 56. An end of the fixed shaft 56 is mounted at the side frame 30. The lever 58 pivots by a spring (not shown) and the biasing roller 54 contacts the pinching roller 50.

A second electric motor 66 is located above the rotating shaft 40 and the second rotating shaft 46 and is fixed at the side frame 30. A belt 68 is wound around a pulley which is fixed on the output shaft of the second electric motor 66, a pulley that is fixed on the first rotating shaft 40, and a pulley that is fixed on the second rotating shaft 46. The belt 68 preferably moves in a counter clockwise direction as shown in FIG. 3. Alternatively, the second transporting unit 38 can be changed to another device type that pinches the card 10 between a pair of belts.

A dispensing detection sensor 70 is adjacent to the second roller 48 and a contacting member 72 of the dispensing detection sensor 70 is located at the transporting passageways of card 10. When the lever 58 is located at a predetermined angular position the duplicate detecting sensor 20 outputs a duplicate detecting signal indicating more than one card is being dispensed. When more than one card 10 is pinched between the pinching roller 50 and the biasing roller 54 at the same time, the lever 58 pivots in the clockwise direction more than expected and a rotation detection sensor (not shown) detects the larger than expected rotation of the lever 58 and outputs a duplicate signal.

A shutter 78 is supported on a second fixed shaft 76 and is rotatable along the transporting passageway 74 that is located between the second transporting unit 38 and the dispensing slot 44. The shutter 78 pivots in the counter clockwise direction by a spring (not shown) as shown in FIG. 3 and is located on the transporting passageway 74. When the card 10 moves on the transporting passageway, a shutter 78 is pushed by the card 10 and pivots in a clockwise direction away from the transporting passageway 74. After this, the card 10 reaches the dispensing slot or opening 44.

Figure 2:
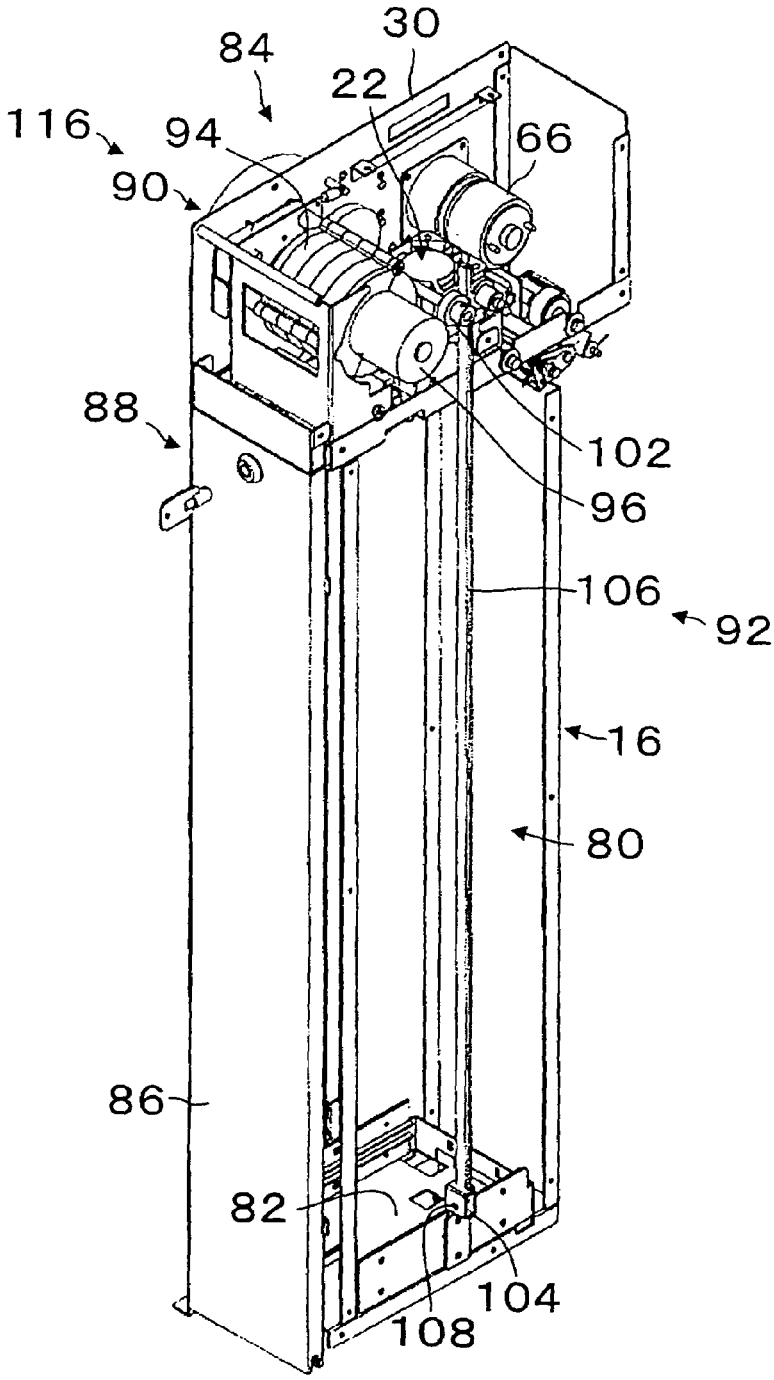
FIG. 2 is a perspective view of the automatic card dispensing apparatus with the left-side cover removed in accordance with an embodiment of the present invention.

In reference to FIG. 2, the storing section 16 for a stack of cards 10 is shown and explained. The storing section 16 includes a storing space 80 that extends vertically and a platform 82 that moves the cards 10 by the moving device 84. The storing space 80 is generally a rectangular column that extends vertically below the vacuum unit 22 and is enclosed by side frames 30 and a lid 86.

The lower section of the lid 86 can be attached at the side frame 30 where it is both pivotable and detachable. The upper section of the lid 86 can be locked to the side frame 30 by a locking device 88. When the lid 86 is detached from the side frame 30, the storing space 80 is open, and new cards 10 can be stacked upon the platform 82 to replenish the supply of cards 10 for dispensing. The platform 82 can have a rectangular shape conforming to the rectangular space of the storing section 16.

The platform can move towards or away from a position below the guiding tube 26 in the storing space 80 in order to position the stack of cards 10 so that the top card 10 is near the vacuum stream and may be attracted towards the passageway 74. Stated differently, the platform 82 can move up and down to position cards 10 near the dispensing unit 18. Alternatively, the platform 82 can be changed to another device which has the same function.

In reference to FIGS. 2 and 3, the moving device 84 is shown and explained. The moving device 84 includes a driving device 90 and a transmitting device 92. The driving device 90 is located beside the vacuum unit 22. The driving device 90 includes a reducer 94 that is that is supported at the side frame 30, a third electric motor 96 for driving the reducer 94, a driving gear (not shown) which is fixed on the output shaft of reducer 94, a rotating shaft 98 that is supported at side frame 30 and is rotatable, a driven gear 100 which is engaged to the driving gear and a gear 102 which is fixed on the right end section of the rotating shaft 98. A right hand gear is not shown. The driving device 90 moves the platform 82 towards or away from the vacuum unit 22 through transmitting device 92. Alternatively, the driving device 90 can be changed to another type of mechanism with the same function.

In reference to FIGS. 1 and 2, the left side transmitting device 92 is shown and explained. Although only the left side transmitting device 92 is described, a right side transmitting device is located at the right side of side frame 30 and has the same structure. The lower end of a rack 106 is attached at stay 104 by pin 108 and is rotatable. The stay 104 protrudes in the lateral direction away from platform 82. The rack 106 can be made of a flexible resin or plastic and is bendable. The center portion of the front side of the rack 106 engages with the gear 102. The rear side of the rack 106 is held by a pinch roller 112 which rotates on fixed shaft 110 protruding from side frame 30. Accordingly, the rack 106 has contact with gear 102.

An end of the rack 106 can be inserted into a pipe 114 which is shaped as an inverted J and mounted at the side of side frame 30. The transmitting device 92 is compact and adaptable to miniaturization because a flexible rack 106 is used and can be partially retained in either the J or U shape pipe 114. In one embodiment, the moving device 84 is a hoisting device 116 to move the platform 82 in an up and down motion. The moving device 84 changes the distance between vacuum unit 22 and one or more cards 10 supported on the platform 82.

In one embodiment, the dispensing unit 18 can be movable while platform 82 is fixed in position. However, if the dispensing unit 18 is movable, the dispensing slot 44 location would be undesirably changed during dispensing. Therefore, it is preferred that the platform 82 be movable while the dispensing unit 18 is fixed in position. Alternatively, the driving device 90 and transmitting device 92 can be integrated into one unit. For example, a magnetic plate of a linear motor can be positioned beside the side frame 30, and the platform can be connected with a coil plate of the linear motor.

In reference to FIG. 3, a position sensor 118 is shown and explained. The position sensor 118 is fixed at a base board 120 which is located between side frames 30 and is held level. A contacting member 122 for the position sensor 118 is located at the upper space of the storing section 80. A lower section of the contacting member 122 is located below the vacuum opening 32. When the contactor 122 is slightly pushed up by a uppermost or topmost card 10, the position sensor 118 outputs a position sensor signal indicating an "ON" condition and communicating the presence of the uppermost or top card 10 against the contacting member 122 and actuating the position sensor 118.

In this case, the position of the contacting member 122 is located at a predetermined position that is a predetermined distance between the uppermost card 10 and the vacuum opening 32. This detection allows the uppermost card 10 to be dispensed while the next card 10 below the uppermost card in the stack is not attracted by the vacuum unit 22. The attachment position of the position sensor 118 is adjustable up and down as shown in FIG. 3. When the mechanical position sensor 118 is integrated with the contacting member 122, it does not require periodic maintenance, and can be economically manufactured. Alternatively, the position sensor 118 can be changed to a different type of sensor such as a photo-electric or optical sensor.

Next, a high-level description of the card dispensing operation is described in reference to the previously discussed units and components. When a dispensing request signal 124 is received by a control unit 126 indicating a request to dispense only one card 10 from the stack of cards 10, the control unit 126 activates the third motor 96 of the moving device 84 in a reverse direction. The gear 102 is then rotated in a clockwise direction through the reducer 94, the driven gear 100, and the rotating shaft 98, as shown in FIG. 3. This causes the rack 106 to move downwards allowing the platform 82 and one or more cards 10 on the platform 82 to move in a downward direction away from the dispensing unit 18.

As the platform 82 and cards 10 move downward, the contacting member 122, which was previously pushed up by card 10 in an activated position, now moves downwards in a deactivated position, and the position sensor 118 outputs a position sensor signal indicating an "OFF" signal and communicating a card 10 is not properly positioned against the contact member 122 and adjacent to the pickup unit 22. At this point, the uppermost card 10 on the stack of cards is positioned away from the dispensing unit 18 at a sufficient distance that the uppermost card 10 cannot be attracted by the vacuum generating unit 28 in the dispensing unit 18. When the OFF signal is recognized by the control unit 126 the movement of the third motor 96 in the reverse direction is stopped and is changed to rotate oppositely in the forward direction.

In forward rotation, the gear 102 rotates in the counter clockwise direction shown in FIG. 3 causing the rack 106 and the platform 82 to move upwards. By the movement of the platform 82, the stack of cards 10 is moved upwards where the uppermost card 10 makes contact with the contacting member 122 which is subsequently pushed in the upwards direction. In this case, the position sensor 118 outputs an "ON" signal and an upper position signal is outputted to the control unit 126. With the platform 82 in this position the uppermost card 10 can be dispensed from the dispensing unit 18. When the upper position signal is recognized by the control unit 126, the third motor 96 is stopped from the forward rotation. In this process, the uppermost card 10 on the platform 82 is confirmed to be located at an optimal position for dispensing by the dispensing unit 18.

Next, the first electric motor 34 of the vacuum generating unit 28 and the second motor 66 of the transporting unit 24 are activated. By the rotation of motor 34, the attached fan is also rotated creating a moving stream of air comprising a vacuum stream into the vacuum opening 32. By the rotation of the second motor 66, the roller 42 of the first transporting unit 36 through belt 68, rotating shaft 40 and pinching roller 50 of the second transporting unit 38 through rotating shaft 46 is also rotated in the counter clockwise direction as shown in FIG. 3. In this manner, the uppermost card 10 is pulled up by the vacuum stream and is attracted towards the vacuum opening 32. The vacuum stream attracts the uppermost card 10 into a dispensing position within the dispensing unit 18.

When a card 10 bent as shown in the dotted line of FIG. 3, the top of the convex portion is pulled up and has contact with first transporting unit 36 because the card 10 which faces towards the vacuum opening 32 is pulled up. In this manner, the attracted or pulled up card 10 has contact with the first roller 42 and is transported towards the second transporting unit 38 by the roller 42 causing the card 10 to pull away from the initial position at the vacuum opening 32. Therefore, a middle portion of the card 10 is predominantly attracted to the vacuum opening. As a result, the contacting section of the card to the vacuum opening 32 is offset, and creates a pivot at the contacting point as dotted line shown in FIG. 3. Stated differently, the end of card can move slightly downwards away from the passageway 74 being deflected due to bending. In this situation, the leading edge of the uppermost card 10 in the direction of dispensing makes contact with the biasing roller 54.

The biasing roller 54 rotates in the clockwise direction by the rotation in the counter clockwise direction of the pinching roller 50 shown in FIG. 3 since the biasing roller 54 has contact with pinching roller 50. Stated differently, the biasing roller 54 is passively driven by contact with the pinching roller 50. A projection 62 on the biasing roller 54 has contact with the leading edge of the bent card 10, and pushes the leading edge upwards towards the passageway 74. As a result, the leading edge of the bent card is directed towards to passageway 74 and into alignment for reliable dispensing. In this manner, the previously bent card 10 is accepted between the pinching roller 50 and the biasing roller 54 of the second transporting unit 24 and is reliably transported towards a dispensing slot 44.

As the card 10 is transported towards the dispensing slot 44 it makes contact with a shutter 78 that is pivoted in the clockwise direction out of the card dispensing passageway 74. When the passageway 74 between the second transporting unit 24 and the dispensing slot 44 is enclosed by a guiding board (not shown), the card 10 can move towards the dispensing slot 44 in spite of the added resistance. When the card 10 is located between the pinching roller 50 and the biasing roller 54, the biasing roller 54 moves downwards a predetermined amount depending on the thickness of the card 10. As this happens, a lever 58 is rotated in the clockwise direction as shown in FIG. 3.

When only one card 10 is located between the pinching roller 50 and the biasing roller 54, the pivoted angle of lever 58 is less than a predetermined angle value. However, when more than one card 10 is located between the pinching roller 50 and the biasing roller 54, the pivoted angle of the lever 58 is greater than the predetermined angle. In this manner, when the pivoted angle of the lever 58 is detected to be over a predetermined angle, more than one card is being dispensed and a duplicated dispensing signal is outputted to the control unit 126. In this case, a dispensing stop signal 128 and an alarm signal 130 based on the abnormal signal are outputted, the automatic dispensing apparatus 12 is stopped, and an alarm element (not shown) is activated to sound an alarm. Also, when the card 10 passes through the second transporting unit 38, the contacting member 72 is pushed up, and the dispensing sensor 70 outputs a dispensing signal. The stopping of the dispensing operating includes deactivating the first motor, the second motor. The third motor is already deactivated prior to starting the first motor and the second motor.

When the card 10 passes through the second transporting unit 38, the contacting member 72 moves downwards, and the dispensing sensor 70 outputs the "OFF" signal. When the OFF signal is asserted to the control unit 126, the motor 34 in the vacuum generating unit 28 and the motor 66 in the transporting unit 24 are stopped. In this way, the vacuum generating unit 28 is stopped, and the vacuuming function of the vacuum unit 22 is also stopped. Since the transporting unit 24 is stopped, the rotations of the first roller 42 and the pinching roller 50 are stopped and the transporting function is disabled. Subsequently, when the ON signal from the position sensor 118 is recognized after the contacting member 122 which is pushed up by the uppermost card 10, the third motor 96 is reversed. In this manner the platform 82 is moved downwards through the rack 106, as has been previously described.

If the uppermost card 10 is dispensed and immediately the next uppermost card 10 pushes up to contactor 122, the next uppermost card 10 could be inadvertently pulled by the residual vacuum stream caused by the rotational inertia of the fan within the vacuum unit 22. The next uppermost card could then be inadvertently transported by the rotational inertia of the transporting unit 24 to the dispensing slot 44. In an embodiment, the platform 82 carrying the card 10 is moved downwards after attracting the first card so that the next uppermost card 10 cannot be pulled by the vacuum unit 22 and inadvertent or accidental dispensed. Thus, accidental dispensing of duplicate cards is prevented.

After the platform 82 is lowered, the third motor 96 rotates normally, and the platform 82 is again lifted up. After this, the contacting member 122 is pushed up by the uppermost card 10 causing the position sensor 118 to output an upper position signal to the control unit 126. When the upper position signal is recognized, the third motor 96 is stopped, and the uppermost card 10 is kept in an optimal position which is away from but adjacent to the vacuum unit 22 at a predetermined distance. The conventions of the directions such as "up and down" and "left and right" as used in this description are meant to indicate relative positions and movements and are not to be considered limiting. In one embodiment, the apparatus as described can be disposed on its side.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A card dispensing apparatus, comprising:

a support unit for supporting a plurality of cards arranged in a stack, the support unit being driven by a third motor to move in a first direction and a second direction opposite to the first direction;

a pickup unit disposed adjacent to the stack of cards for attracting a first card of the plurality of cards, the pickup unit being a vacuum unit driven by a first motor, the first card being bent so that a predetermined portion of the first card is displaced from alignment with a card dispensing passageway;

a position sensor disposed adjacent to the pickup unit for detecting when a card is adjacent to the pickup unit and outputting a position sensor signal;

a transporting unit disposed adjacent to the pickup unit for receiving and moving the first card attracted by the pickup unit along the card dispensing passageway, the transporting unit being driven by a second motor;

a biasing unit for urging a predetermined portion of the first card towards the card dispensing passageway, the biasing unit having at least one biasing roller, the biasing roller including at least one radial projection for contacting the predetermined portion of the first card;

a control unit for receiving a dispensing request signal and the position sensor signal and activating the first electric motor, the second electric motor and the third electric motor to dispense one card from the stack of cards;

a duplicate detecting sensor for outputting a duplicate signal indicating more than one card is being dispensed;

wherein the control unit receives the duplicate detecting signal and outputs a dispensing stop signal and an alarm signal and deactivates the first motor and the second motor.

2. The card dispensing apparatus of claim 1, wherein the pickup unit and the transporting unit are disposed adjacent to a first side of the card dispensing passageway, and wherein the biasing unit is disposed adjacent to a second side of the card dispensing passageway opposite to the first side.

3. The card dispensing apparatus of claim 1, further comprising:

a plurality of grooves in each radial projection for capturing the predetermined portion of the first card to urge the end portion of the first card in the direction of dispensing towards the card dispensing passageway.

4. The card dispensing apparatus of claim 1, wherein the biasing unit includes a first biasing roller and a second biasing roller, the first biasing roller and the second biasing roller being separated from each other by a predetermined distance and mounted on a common rotatable shaft.

5. The card dispensing apparatus of claim 1, a pinching roller for contacting the biasing roller, the pinching roller being disposed adjacent to the passageway and opposite the biasing roller.

6. The card dispensing apparatus of claim 5, wherein the biasing roller is passively driven by contact with the pinching roller.

7. The card dispensing apparatus of claim 1, wherein the biasing roller includes an abrasion resistant rubber.

8. The card dispensing apparatus of claim 1, wherein the abrasion resistant rubber is Ethylene-Propylene Diene Monomer (EPDM).

9. The apparatus of claim 1, further comprising:

a dispensing sensor for outputting a dispensing signal indicating a card has been successfully dispensed, wherein the control unit receives the dispensing signal and deactivates the first motor and the second motor.

10. The apparatus of claim 1, wherein third motor is activated first to move the support unit in a first direction away from the pickup unit until the position sensor signal indicates a card is not adjacent to the pickup unit, the third motor is then activated to move the support unit in a second direction towards the pickup unit until the position sensor signal indicates a card is adjacent to the pickup unit.

11. A card dispensing apparatus, comprising:

a support unit for supporting a plurality of cards arranged in a stack, the support unit being driven by a third motor to move in a first direction and a second direction opposite to the first direction;

a pickup unit disposed adjacent to tire stack of cards for attracting a first card of the plurality of cards, the pickup unit being a vacuum unit driven by a first motor, the first card being bent so that a predetermined portion of the first card is displaced from alignment with a card dispensing passageway;

a position sensor disposed adjacent to the pickup unit for detecting when a card is adjacent to the pickup unit and outputting a position sensor signal;

a transporting unit disposed adjacent to the pickup unit for receiving and moving the first card attracted by the pickup unit along the card dispensing passageway, the transporting unit being driven by a second motor;

a biasing unit for urging a predetermined portion of the first card towards the card dispensing passageway, the biasing unit having at least one biasing roller, the biasing roller including at least one radial projection for contacting the predetermined portion of the first card;

a control unit for receiving a dispensing request signal and the position sensor signal and activating the first electric motor, the second electric motor and the third electric motor to dispense one card from the stack of cards; and a dispensing sensor for outputting a dispensing signal indicating a card has been successfully dispensed, wherein the control unit receives the dispensing signal and deactivates the first motor and the second motor.

12. The card dispensing apparatus of claim 11, wherein the pickup unit and the transporting unit are disposed adjacent to a first side of the card dispensing passageway, and wherein the biasing unit is disposed adjacent to a second side of the card dispensing passageway opposite to the first side.

13. The card dispensing apparatus of claim 11, further comprising:

a pinching roller for contacting the biasing roller, the pinching roller being disposed adjacent to the card dispensing passageway and opposite the biasing roller.

14. The card dispensing apparatus of claim 13, wherein the biasing roller is passively driven by contact with the pinching roller.

15. The card dispensing apparatus of claim 14, wherein the biasing roller includes an abrasion resistant rubber.

16. The card dispensing apparatus of claim 15, wherein the abrasion resistant rubber is Ethylene-Propylene Diene Monomer (EPDM).

17. The card dispensing apparatus of claim 11, further comprising:

a plurality of grooves in each radial projection for capturing the predetermined portion of the first card to urge the end portion of the first card in the direction of dispensing towards the card dispensing passageway.

18. The card dispensing apparatus of claim 11, wherein the biasing unit includes a first biasing roller and a second biasing roller, the first biasing roller and the second biasing roller being separated from each other by a predetermined distance and mounted on a common rotatable shaft.

* * * * *